US006478608B1

(12) United States Patent
Grant et al.

(10) Patent No.: US 6,478,608 B1
(45) Date of Patent: Nov. 12, 2002

(54) ELECTRICAL CONNECTOR INCLUDING A LOCKINGLY ENGAGEABLE HOUSING AND COVER

(75) Inventors: Matthew Grant, Yokkaichi (JP); Koichi Matsumoto, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/579,018

(22) Filed: May 26, 2000

(30) Foreign Application Priority Data

Jun. 30, 1999 (JP) ..... 11-185577

(51) Int. Cl.[7] ..... H01R 13/58; H01R 13/73
(52) U.S. Cl. ..... 439/468; 439/456; 439/902
(58) Field of Search ..... 439/701, 456, 439/468, 902

(56) References Cited

U.S. PATENT DOCUMENTS 5,921,806 A * 7/1999 Shuey ..... 439/464
6,050,838 A * 4/2000 Norizuki et al. ..... 439/310

FOREIGN PATENT DOCUMENTS

JP 10-112347 4/1998

* cited by examiner

*Primary Examiner*—Tulsidas Patel
*Assistant Examiner*—Chandrika Prasad
(74) *Attorney, Agent, or Firm*—Banner & Witcoff, Ltd.

(57) ABSTRACT

An electrical connector has a cover (20) attached by a center latching arm (15) and two side latching arms (26). The rigidity of a center arm (15) is decreased, and the rigidity of side arms (26) is increased, by specifying the material from which a housing (10) and a cover (20) are formed. Neither of the two side edges of the center arm (15) join with other parts. This decreases the rigidity of the center arm (15). An edge of each side arm (26) is joined to an L-shaped circumference wall (27). As a result, the rigidity of the side arms (26) is high. By this means, the release operation of the center arm (15) is improved, and the side arms (26) are not vulnerable to accidental released by a pull on the electric wires (12).

11 Claims, 3 Drawing Sheets

ELECTRICAL CONNECTOR INCLUDING A LOCKINGLY ENGAGEABLE HOUSING AND COVER

TECHNICAL FIELD

The present invention relates to an electric connector provided with a cover.

BACKGROUND OF THE INVENTION

A conventional example of a connector provided with a cover is described in JP 10-112347. This connector comprises a housing and a cover. Terminal fittings are inserted into the housing, and electric wires which are fixed to the terminal fittings are guided outwards via an electric wire guiding face provided on a rear face of the housing. The cover is attached to the housing so as to cover the electric wire guiding face. The cover is block-like, one side thereof being joined to the housing by a hinge. The remaining three sides have resilient latching arms protruding therefrom. When the cover is attached to the housing, these latching arms engage with latching protrusions which protrude from the housing, these three arms latching the cover to the housing in an attached state.

In this prior connector, the cover is removed from the housing by bending the latching arms and separating them from the protrusions. However, it is difficult to bend all three arms at the same time. In order to deal with this problem a configuration is possible whereby the cover is a component separate from the housing and is not joined thereto by a hinge. In this configuration, the cover is inclined towards the housing with only a centre latching arm being in a bent state. A latching arm is located at each side of the centre arm. The inclining operation causes one of these two latching arms to separate from its protrusion. Then, the cover is inclined in the opposite direction. thereby separating the other arm from its protrusion. In this manner. all three latching arms are separated from their respective protrusions, and the cover can be removed from the housing.

It is desirable to decrease the rigidity of the centre latching arm so as to improve the ease with which it can be bent in a releasing direction. Furthermore, the rigidity of the side latching arms should be increased to deal with the case where an external force causes the electric wires to interfere with these side arms and thereby move them in the releasing direction.

However, in the prior example, all of the three latching arms are formed in a unified manner with the cover. As a result, if the rigidity of one of these arms is increased or decreased by changing the material used for the cover, the rigidity of the other arms also increases or decreases. Consequently, if the rigidity of the centre arm is decreased so as to improve its releasing operability, the side arms are more easily moved in the releasing direction when the electric wires interfere therewith. Conversely, if the rigidity of the side arms is increased so as to prevent them from being moved in the releasing direction by the electric wires, the releasing operability of the centre arm worsens.

The present invention has been developed after taking the above problem into consideration, and aims to present a connector provided with a cover wherein the latch release operation of the centre arm is improved, and wherein the side arms are not released from their latched state as a result of interference from the electric wires.

SUMMARY OF THE INVENTION

According to the invention there is provided an electrical connector comprising a housing having an exit face for wires. and a cover for said exit face, the housing and cover having three mutually engageable resilient latching means, said latching means comprising a centre latching arm and two side latching arms, characterised in that said centre latching arm is a cantilever, and each of said side latching arms are joined along one side edge to a respective portion of one of said housing and cover. the other side edge being free.

Such a cover/housing combination permits good flexibility of the centre arm, but allows the side arms to be rather stiff since they are not cantilevers.

In a preferred embodiment the side arms are provided on the cover and attached along one edge to a wall of the cover, substantially at right angles. This makes the side arms comparatively stiff.

The centre arm preferably latches within the cover, in an aperture of the wall thereof. The cover is preferably symmetrical and the side arms identical but in mirror image.

The centre arm may have an outwardly directed latching protrusion, whereas the side arms may have respective inwardly directed protrusions.

BRIEF DESCRIPTION OF DRAWINGS

One feature of the invention will be apparent from the following description of a preferred embodiment shown by way of example only in the accompanying drawings in which.

DESCRIPTION OF PREFERRED EMBODIMENT

Figure 1:
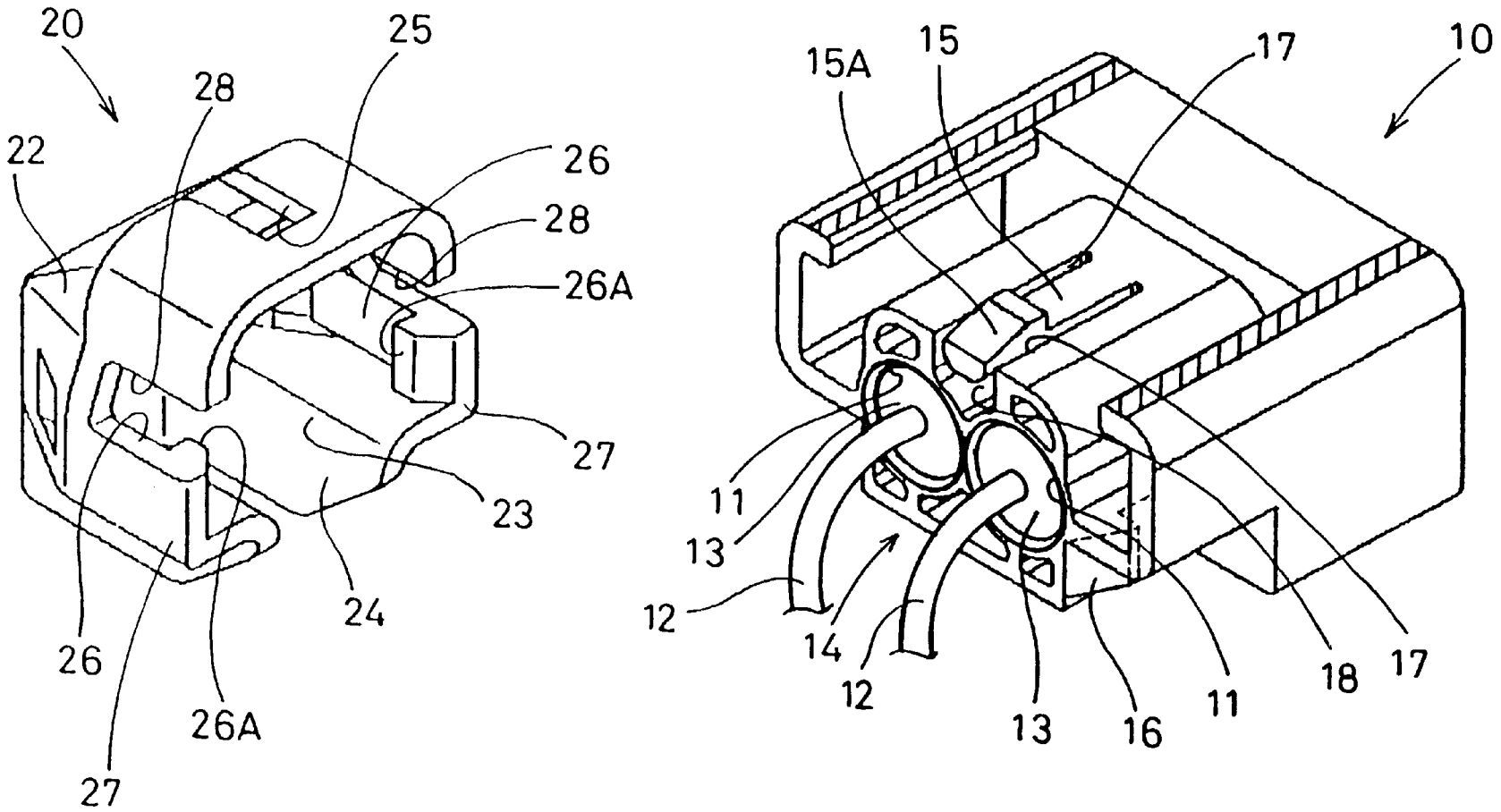
FIG. 1 is a partially cut-away diagonal view of a housing of an embodiment of the invention showing a cover in a removed state therefrom.
Figure 2:
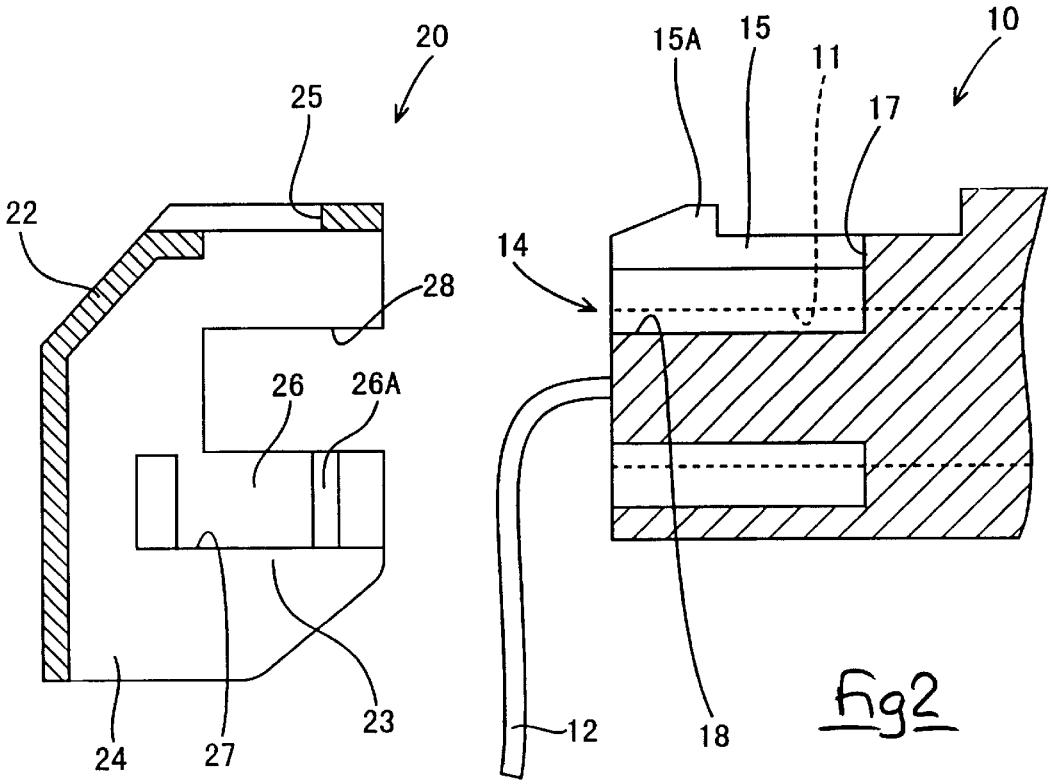
FIG. 2 is a vertical cross-sectional view showing the cover in the removed state from the housing.
Figure 3:
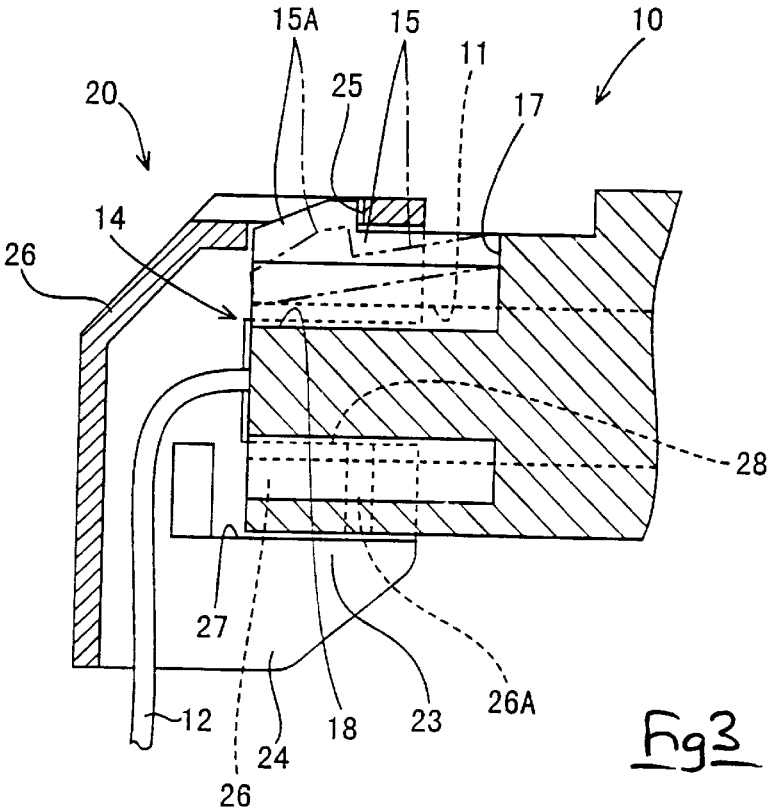
FIG. 3 is a vertical cross-sectional view showing the cover in an attached state with the housing.
Figure 4:
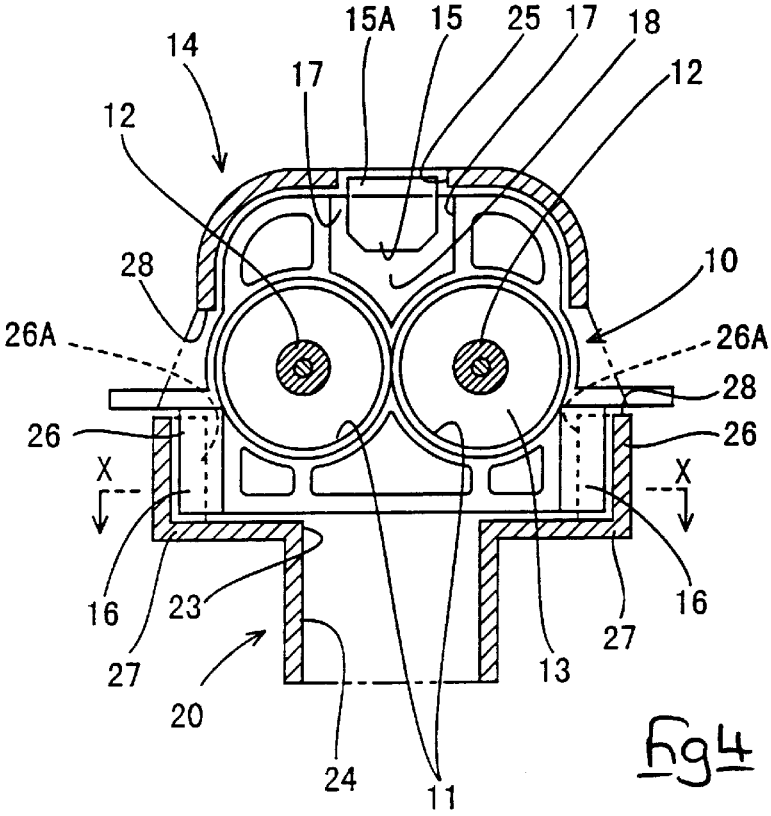
FIG. 4 is a horizontal cross-sectional view showing the cover in the attached state with the housing.
Figure 5:
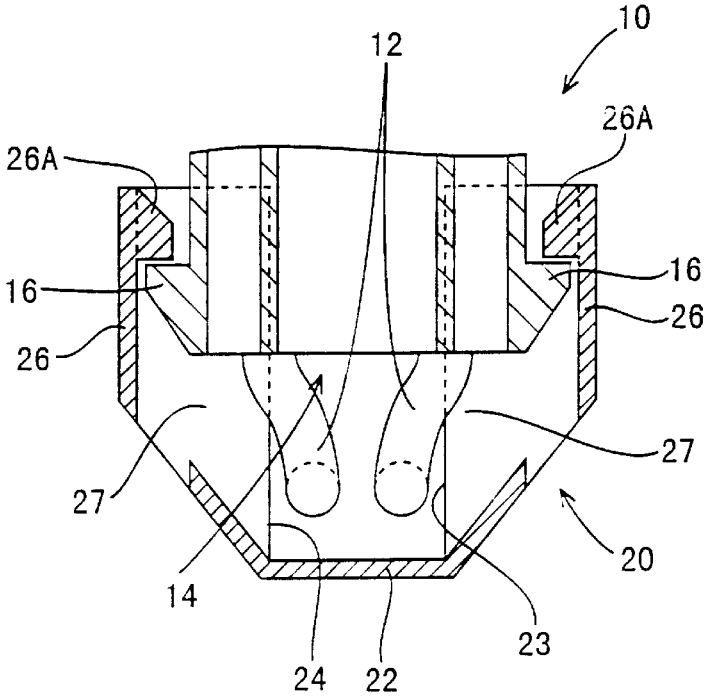
FIG. 5 is a cross-sectional view of FIG. 4 along the line X—X.

An embodiment of the present invention is explained below with the aid of FIGS. 1 to 5.

A connector of the present embodiment is provided with a housing 10 made from plastic, and a cover 20. The housing 10 has a pair of left and right cavities 11, terminal fittings (not shown) being inserted from the posterior into these cavities 11. An electric wire 12 is joined to each terminal fitting passes through a rubber stopper 13, which is fitted to an opening of each cavity 11. The electric wire 12 extends to the exterior of the housing 10. A posterior end face of the housing 10 guides the electric wires 12 and in an approximately square electric wire guiding face 14 (also referred to herein as an "exit face"). The cover 20 is attached to a posterior end portion of the housing 10 so as to cover the electric wire guiding face 14.

The housing 10 is provided with a centre locking arm 15 and a left and right pair of locking protrusions 16 which serve to maintain the cover 20 in an attached state with the housing 10. The centre locking arm 15 is formed on an upper face of an outer circumference of a posterior end portion of the housing 10. This centre locking arm 15 has a cantilevered shape which protrudes in a posterior direction, and an upper face of a protruding end thereof has a locking protrusion 15A which protrudes beyond an outer face of the housing 10. Left and right side edges of the centre locking arm 15 do not join with other parts of the housing 10. That is, a pair of slits 17 are formed between the left and right side edges of the centre locking arm 15 and the upper face of the outer circumference of the housing 10 so that the centre locking arm 15 remains separate. These slits 17 are provided in the upper face of the outer circumference of the housing to the posterior, and bending spaces 18 are formed below the centre locking arm 15. The pair of locking protrusions 16 are formed at lower portions of left and right side faces of the outer circumference of the housing 10.

The cover 20 is approximately square in shape and is attached to the posterior end portion of the housing 10 so as to cover the electric wire guiding face 14. The cover 20 fits with the exterior of the housing 10, and has a posterior wall 22 which protrudes towards the posterior. When the cover 20 is attached to the housing 10, this posterior wall 22 is opposite the electric wire guiding face 14. A central portion in a left-right direction of a lower face of the cover 20 has a cut-away 23 which is open at its anterior edge. Left and right edges and a posterior edge of the cut-away 23 extend downwards, and form a guiding member 24. An anterior face and a lower face of the cover 20 are open. When the cover 20 is in an attached state with the housing 10, the electric wires 12, which are guided outwards via the electric wire guiding face 14, are bent downwards within the cover 20 and are guided downwards to the exterior of the cover 20 from a lower face of the guiding member 24.

The cover 20 is provided with a locking hole 25 and a left and right pair of side locking arms 26 as a means to maintain the cover 20 in an attached state with the housing 10. The locking hole 25 passes from an inner side to an outer side. When the cover 20 is attached, the locking protrusion 15A of the centre locking arm 15 engages with the locking hole 25, thereby locking the cover 20. When the cover 20 is to be removed, the locking protrusion 15A, which is in the locking hole 25, is pressed, thereby causing the centre locking arm 15 to bend, and the lock is thereby released. The pair of side locking arms 26 are provided on left and right side faces of the cover 20, these side locking arms 26 consisting of a long and narrow portion of each side wall which extends in an anterior-posterior direction. A locking protrusion 26A is formed at an anterior end of each locking arm 26, these locking protrusions 26A protruding inwards from the inner circumference of the cover 20. A lower edge of each side locking arm 26 is unified with the lower half of the side walls of the cover 20 and approximately L-shaped circumference walls 27 which extend up to outer side edges of the lower face of the cover 20. Further, both posterior ends of theses L-shaped circumference walls 27 are joined by the posterior wall 22 of the cover 20. Lower edges of the circumference walls 27 join at approximately right angles with upper ends of the guiding member 24. Recessed grooves 28 are formed between upper ends of the side locking arms 26 and upper halves of the side walls of the cover 20, these recessed grooves 28 being open at the anterior end. As a result, the upper ends of the side locking arms 26 do not join with other parts of the cover 20.

Next, the operation of the present embodiment will be explained.

The cover 20 may be attached by pressing it onto the housing 10 from the posterior. During this attachment process, the locking protrusion 15A of the centre locking arm 15 makes contact with the anterior end of the upper face of the cover 20, and is thereby bent downwards (towards the inner side). Simultaneously, the locking protrusions 26A make contact with the locking protrusions 16 of the housing 10, and are thereby bent outwards. When the cover 20 has reached a correct fitted state, the centre locking arm 15 returns to its original position and the locking protrusions 15A thereof engages with the locking hole 25 of the cover 20. Simultaneously, the side locking arms 26 return to their original position and the locking protrusions 26A thereof engage with the locking protrusions 16 of the housing 10. These operations latch the cover 20 to the housing 10.

If, in this attached state, the electric wires 12 receive a pulling force from the side so as to press on the lower edge of the guiding member 24, this pulling force is transmitted via the guiding member 24 and the circumference walls 27, and acts as a force to bend the side locking arms 26 outwards (in a direction of separation from the locking protrusions 16). However, in the present embodiment, the lower edges of the side locking arms 26 are joined to the L-shaped circumference walls 27, and both circumference walls 27 are joined to the posterior wall 22. As a result, the rigidity thereof is increased and the side locking arms 26 are not bent in the lock separating direction.

Further, if the electric wires 12 receive a pulling force from the posterior (a direction of separation from the electric wire guiding face 14) so as to press on the lower end of the posterior wall 22, this pulling force is transmitted via the posterior wall 22. the guiding member 24 and the circumference walls 27, and acts as a force to bend the side locking arms 26 towards the posterior of the locking protrusions 16. However. in the present embodiment, the lower edges of the side locking arms 26 are joined to the L-shaped circumference wall 27, and both circumference walls 27 are joined to the posterior wall 22. As a result, the rigidity thereof is increased, and the side locking arms 26 are not released from their latched state.

The cover 20 is separated from the housing 10 by pressing the protrusion 15A which is in the locking hole 25, with a jig (not shown). The centre locking arm 15 is bent towards the interior, and the latch between the centre arm 15 and the hole 25 is released. Next, while this state is being maintained, the cover 20 is inclined to the left or the right (as seen from above), so as to pull either the left or right side wall towards the posterior. As a result, the left and right side walls widen, and one of the side locking arms 26 separates from its locking protrusion 16. Next, the cover 20 is inclined in the opposite direction and the other side locking arm 26 separates from it locking protrusion 16. By this means, all of the arms 15 and 26 are released. Next, the cover 20 may be separated from the housing 10 by pulling it towards the posterior.

Neither of the two side edges of the centre locking arm 15, which is pressed by the jig when the separating operation is performed, join with other parts. Consequently the rigidity of the centre locking arm 15 is low and the lock is easily released by the jig. In the present embodiment, the centre locking arm 15 has a reduced rigidity and consequently the lock-release operation thereof is improved. Moreover, the side locking arms 26 have an increased rigidity, and consequently they are not released from their locked state as a result of interference from the electric wires 12.

Furthermore, the centre locking arm 15 and the side locking arms 26 are formed on mutually opposing components (the centre locking arm 15 being formed on the housing 10, and the side locking arms 26 being formed on the cover 20). As a result, changing the materials from which the housing 10 and the cover 20 are formed can reduce the rigidity of the centre locking arm 15 and increase the rigidity of the side locking arms 26. By this means, the lock-release operation of the centre locking arm 15 is improved, and the side locking arms 26 are not released from their locked state as a result of interference from the electric wires 12.

The materials from which the housing 10 and the cover 20 are formed can be specified so as to confirm to the strength required of the housing 10 and the cover 20, to the protruding length, thickness, and width of the centre locking arm 15, and to the rigidity required thereof, and to conform to the protruding length, thickness of the side locking arms 26, to the thickness, dimensions in the circumference direction, and shape of the circumference walls, and to the rigidity required of the side locking arms 26, etc.

The present invention is not limited to the embodiments described above with the aid of figures. For example, the possibilities described below also lie within the technical range of the present invention. In addition, the present invention may be embodied in various other ways without deviating from the scope thereof.

(1) In the present embodiment, the centre locking arm is formed on the housing and the side locking arms are formed on the cover. However, the centre locking arm could be formed on the cover and the side locking arms could be formed on the housing, or both the centre locking arm and the side locking arms could be formed on the housing, or all the locking arms could be formed on the cover.

(2) In the present embodiment, both the side locking arms are formed on the cover. However, one of the pair of side locking arms could be formed on the cover and the other side locking arm could be formed on the housing.

(3) In the present embodiment, the L-shaped circumference walls which join with the side locking arms are provided on the side opposite the centre locking arm. However, the L-shaped circumference walls could be provided on the same side as the centre locking arm.

What is claimed is:

1. An electrical connector comprising:

a housing having an exit face for wires;

a cover received over the exit face;

a locking mechanism for locking said cover to said housing, said locking mechanism comprising:

a cantilever center latching arm on one of the housing and the cover for connecting to the other of the housing and the cover, and two side latching arms, each on one of the housing and the cover for connecting to the other of the housing and the cover, and each said side latching arm including a first free side edge and a second side edge opposite said first side edge and joined therealong to a portion of one of said housing and said cover, and a first free end edge generally transverse to the first free side edge and an opposite second end joined therealong to said one of the housing and the cover.

2. A connector to claim 1 wherein said side latching arms are provided on said cover, the second side edge of each side latching arm being joined to a respective wall of said cover along a respective said second side edge substantially at a right angle to said respective wall of said cover.

3. A connector according to claim 2 wherein said side latching arms are joined via a posterior wall of said cover, said posterior wall lying over said exit face.

4. A connector according to claim 3 wherein said side latching arms have respective inwardly directed protrusions for engagement with respective locking protrusions of said housing.

5. A connector according to claim 4 wherein said side latching arms are identically shaped in mirror image.

6. A connector according to claim 1 wherein said center latching arm includes a protrusion engageable in an aperture provided in a wall of said cover.

7. A connector according to claim 6 wherein said cover includes a wire exit opening opposite said aperture.

8. A connector according to claim 1 wherein said cover is symmetrical.

9. An electrical connector in accordance with claim 1 in which the free side edge of each said side latching arm is defined by a slot in a mid portion of a sidewall of said one of the housing and the cover.

10. An electrical connector in accordance with claim 9 wherein each side latching arm includes a locking protrusion that projects toward the other of the housing and the cover and wherein the side locking arm flexes in a direction opposite to the projection of the locking protrusion to connect to the other of the housing and the cover.

11. An electrical connector in accordance with claim 1 wherein each side locking arm includes a locking protrusion that projects toward the other of the housing and the cover and wherein the side locking arm flexes in a direction opposite to the projection of the locking protrusion to connect to the other of the housing and the cover.

* * * * *